United States Patent [19]

Haffey, Jr.

[11] 4,003,580

[45] Jan. 18, 1977

[54] FOOTBALL GAME

[76] Inventor: John M. Haffey, Jr., 101 Oklahoma Ave., Oak Ridge, Tenn. 37830

[22] Filed: Sept. 17, 1975

[21] Appl. No.: 614,187

[52] U.S. Cl. ..... 273/134 CF; 273/94 R

[51] Int. Cl.[2] ..... A63F 3/00

[58] Field of Search ..... 273/94, 234

[56] References Cited

UNITED STATES PATENTS

| | | | |
|---|---|---|---|
| 3,375,007 | 3/1968 | Meyer | 273/94 R |
| 3,526,403 | 9/1970 | Clark | 273/94 R |
| 3,833,220 | 9/1974 | Schurdell | 273/94 R |
| 3,947,039 | 3/1976 | Sadler et al. | 273/134 CF |

*Primary Examiner*—Delbert B. Lowe

*Attorney, Agent, or Firm*—Herman L. Holsopple

[57] ABSTRACT

An entertainment apparatus is described for simulating the basic play options of the game of college football. The apparatus includes a gameboard to simulate a football field and includes thereon: space at each end for run or pass options to be indicated thereupon, a football-shaped ball position yardline marker, a first down indicator, an individual down indicator, and two play designation markers. Two decks of cards provide a plurality of play situations whereby two persons representing offensive and defensive quarterbacks can match wits to move a simulated football back and forth upon the gameboard. A multiplicity of down cards are controlled by the player starting on the offense while a multiplicity of kick cards are controlled by the defensive player. The offensive player, using a shield to hide his choice from view, chooses either a run or a pass and places a play designation marker on the appropriate space on the gameboard to so indicate. The defensive player, on a signal, then attempts to anticipate the offensive play. The outcome is determined by comparing the offensive call with the defensive guess. Correct defensive guesses are statistically more favorable for the defensive player while incorrect defensive guesses favor the offensive player.

16 Claims, 8 Drawing Figures

| OFFENSE CALL (26) | DEFENSE GUESS (27) | PLAY RESULT (28) |
|---|---|---|
| RUN (29) | RUN | 6 |
| | PASS | 20 |
| PASS (30) | RUN | 30 |
| | PASS | 8 |

25

| | DISTANCE (33) | RUNBACK (34) |
|---|---|---|
| KICKOFF (35) | 50 | 20 |
| Q-KICK (36) | 45 | 20 |
| PUNT (37) | 40 | 30 |

31

| FIELD GOAL (38) | EXTRA POINT (39) |
|---|---|
| GOOD INSIDE 25 | GOOD 1; NO GOOD 2 |

FOOTBALL GAME

BACKGROUND OF THE INVENTION

The invention described herein relates generally to games and more specifically to a simulated football game. As in the actual sport of football, game play strategy by the opponents plays an important part in the outcome.

In the past, a number of simulated football games have been devised involving complicated mechanical and electromechanical chance control systems. Certain of these games tend to disregard the requirement, in actual games, for offensive and defensive strategy. Other prior art football games tend to oversimplify the types of play strategy available to the opponents, whereby the game does not accurately simulate actual football play situations. The simulated football game of the subject invention avoids the disadvantages inherent in complicated mechanical and electromechanical chance controlled devices while providing a more accurate simulation of both offensive and defensive strategy used during the progress of an actual football game.

SUMMARY OF THE INVENTION

A principal object of the subject invention is to provide an improved simulated football game wherein playing skill, as well as chance, combine to determine the outcome of the game.

It is another object of the invention to provide a game wherein multiple play results are possible depending upon the chance choice of a specific offensive card and also depending upon the opponent's tactical choice of the "run" or "pass" option.

A further object of the invention is to provide a game wherein each player participates in every play and who can thereby directly utilize personal strategy to try to outwit his opponent.

A still further object of the invention is to provide a game wherein the effects of chance are statistically introduced, whereby the effects of personal strategy can be altered and which thereby supplies an additional element of excitement to the game.

The invention, accordingly, comprises a simulated football playing field including yardline indicia, means for representing the position of the ball on the simulated playing field, means for indicating the yard line on the simulated playing field which must be achieved in order to accomplish a first down, down indicating means, a multiplicity of play designation down cards having a plurality of play situations disposed thereon, a multiplicity of kick cards having a plurality of kicking situations disposed thereon, and means for achieving secrecy in play selection by the offensive player.

Further features and objects of the invention will be apparent from an examination of the accompanying drawings which illustrate the invention.

BRIEF DESCRIPTION OF THE DRAWINGS

Similar reference characters refer to similar parts throughout the several views of the drawings.

DESCRIPTION OF THE PREFERRED EMBODIMENT

Figure 1:
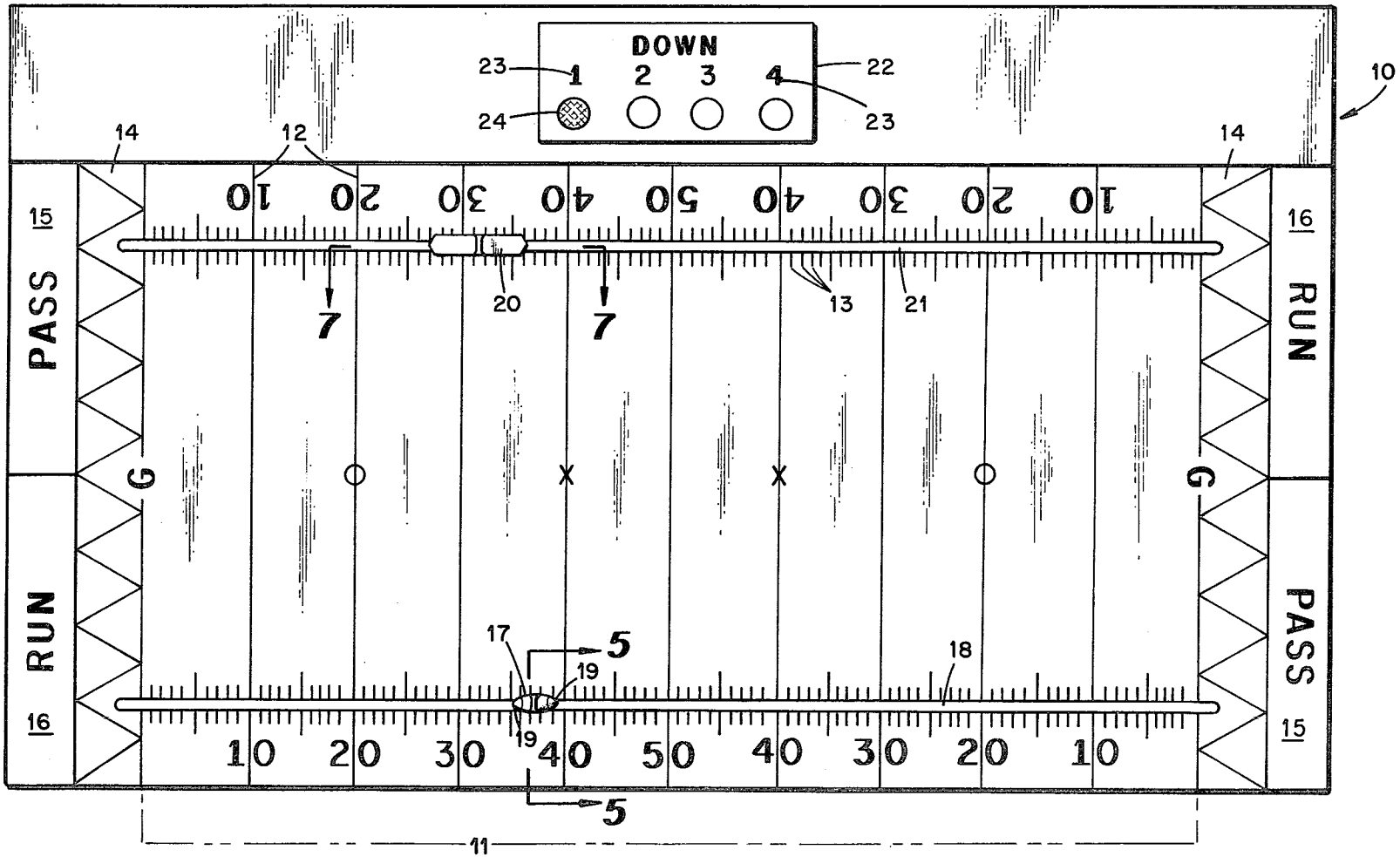
FIG. 1 is a top plan view of the gameboard employed with the cards of the invention and showing a ball position marker, a down marker, play selection markers, and a marker for indicating yardage to be made for a first down thereon.

Having reference to FIG. 1, there is illustrated a top plan view of the rectangular gameboard 10 of the invention showing a simulated 100-yard football field 11 having latitudinal lines 12 running at simulated ten-yard intervals thereacross. Latitudinal lines 12 simulating ten-yard intervals are further subdivided by markings 13 to indicate 1-yard intervals therebetween. An end zone portion 14 is provided at each end of said simulated football field 11. Each end zone portion 14 is bounded interiorly by a goal line G. Beyond each end zone portion 14 of said gameboard 10, indicia are provided whereby players may indicate that a play will be a pass or a run. A pass section 15 and a run section 16 are so labelled.

A football position marker 17 is slidably mounted within a longitudinal groove 18 on one side of simulated football field 11, said football position yardline marker 17 being slidably movable toward either end zone portion 14 and said football position yardline marker 17 having a pointed nose 19 on the two ends thereof.

A first-down yardage-indicating marker 20, having a length corresponding to a simulated ten-yard interval, is slidably mounted within a longitudinal groove 21 on the side of simulated football field 11 opposite to football position marker 17, said first-down yardage-indicating marker being slidably movable toward either end zone portion 14, whereby the 10 yard distance required to be gained for a first down is shown by comparison with the position of football position marker 17.

As in the real game of football, the short-term objective for the offense is to gain at least 10 yards within every four plays in order to keep possession of the football. Thus there are four opportunities for the defensive team to make a first down and thereby continue toward the opponent's goal line.

Referring to FIG. 1, a down marker 22 is provided in gameboard 10 to indicate each play in the series of downs. Down marker 22 is provided with indicia 23 to show which of four downs is currently to be played. Slidable down marker 24 is moved as each down progresses to cover the appropriate indicia 23 which indicates each play in a series of downs.

Two decks of cards provide a plurality of play situations whereby two persons representing, in turn, offensive and defensive quarterbacks can, in the course of the game, match wits to move football position marker 17 back and forth upon gameboard 10 in attempts to score points as in the real game of football.

Figures 2, 3, 4:
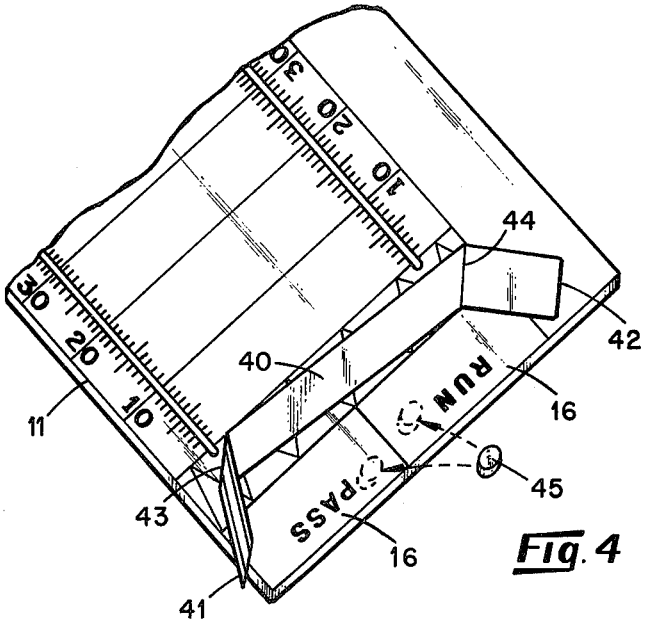
FIG. 2 is a face view of an indicia-bearing down card of the invention.
FIG. 3 is a face view of an indicia-bearing kick card of the invention.
FIG. 4 is a perspective view of the shield used with the invention to hide the play selection of the offensive player from the view of the defensive player.

FIG. 2 is presented as an example of the multiplicity of down cards used in the subject invention. Down card 25 has a plurality of mutually perpendicular columns and rows. Indicia representing offensive calls 26, defensive guesses 27 and play results 28 are arranged columnarly whereby the indicia representing said offensive calls 26 comprise horizontal run row 29 and pass row 30. Thus, a play result is provided where the indicia representing offensive calls intersects defensive guesses 27 in the horizontal plane.

FIG. 3 is an example 31 of the multiplicity of kick cards provided in this invention. Kick card 31 has a plurality of mutually perpendicular columns and rows. Indicia 32 representing the several types of strategic and tactical kicks used to move the ball in the game of football, distances 33 of said kick, and runback 34 of said kick are arranged columnarly whereby the indicia 32 representing said types of kicks comprise a horizontal kickoff row 35, a quick-kick row 36, and a punt row 37.

In addition to indicia 32 representing the several types of strategic and tactical kicks used in the game of football, indicia 38 is provided to give results for attempted field goals and indicia 39 for scoring extra points are also presented on said kick cards 31 in accordance with rules hereinafter defined.

The offensive player chooses either a pass or run option, hiding his choice from the defensive player by means of an opaque shield 40, shown in FIG. 4. Shield 40, in one embodiment, comprises a threesided cardboad, plastic, or metal stand which, by virtue of its shape, consisting of two wings 41, 42, folds inwardly on creases 43, 44, respectively, whereby said opaque shield 40 will stay in position to conceal pass indicia 15 and run indicia 16 from the defensive player. The offensive player indicates his run or pass option by placing a play designation marker 45 in either pass section 15 or run section 16, said choice being made behind said opaque shield 40. The alternative movements are shown in phantom in FIG. 4.

Referring now to FIG. 2, for example, and assuming down card 25 was drawn during the progress of the game, the result of the play may be the result of offensive and defensive strategy in that an offensive decision to run, represented by horizontal run row 29 will result in a gain of 6 yards if the defensive player guesses a run as respresented by the intersection of defensive guess indicia 27 with play result indicia 28. On the other hand, if the defensive player guesses wrong and picks a pass, the offense will gain twenty yards as represented by the intersection of defensive guess indicia with play result indicia 28.

Referring now to FIG. 3, for example, and assuming kick card 31 was drawn during the course of the game for the purpose of determining the length of a punt, the yardage figure seen at the intersection of column 33 representing distances of kicks and row 37 representing punts would be, in this case, "40", indicating a punt of 40 yards. Similarly, if card 31 was drawn for the purpose of determining the runback of a kickoff, the figure is obtained by intersecting kickoff row 35 with runback column 34. In that case the yardage is twenty yards.

Figure 5:
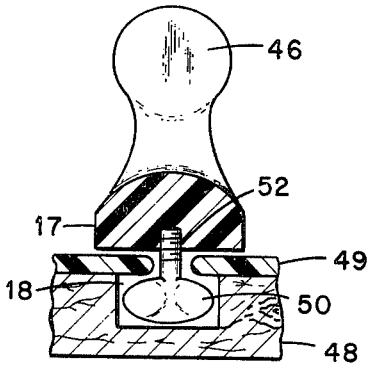
FIG. 5 is a sectional view of the ball position marker when taken along line 5—5 of FIG. 1.
Figure 6:
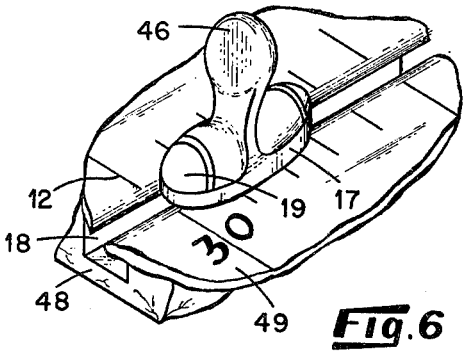
FIG. 6 is an enlarged perspective view of the ball position marker of the invention.
Figure 7:
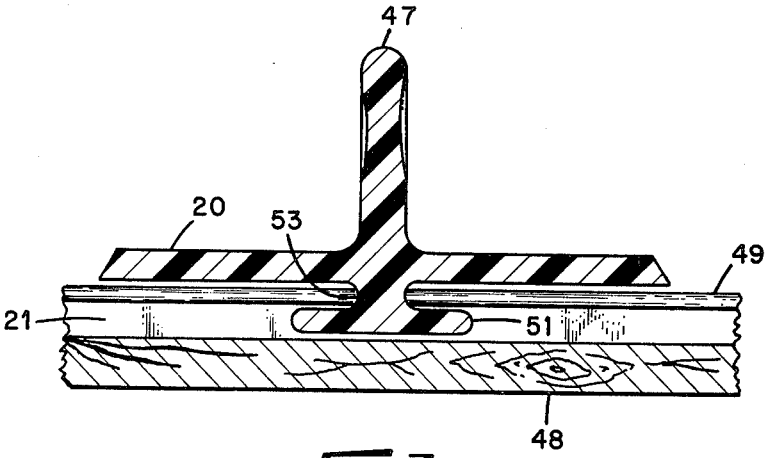
FIG. 7 is a sectional view of the marker for indicating yardage to be made for a first down taken along line 7—7 of FIG. 1 as viewed in the direction indicated by the arrows.

Referring to FIG. 5 and FIG. 6, there is seen a raised projection 46 on football position marker 17 for convenience in grasping and moving said marker 17. Similarly, in FIG. 7 is seen a small knob 47 for moving first-down yardage-indicating marker 20. Football position marker 17 and first-down yardage-indicating marker 20 are thus moved in accordance with rules hereinafter defined.

Figure 8:
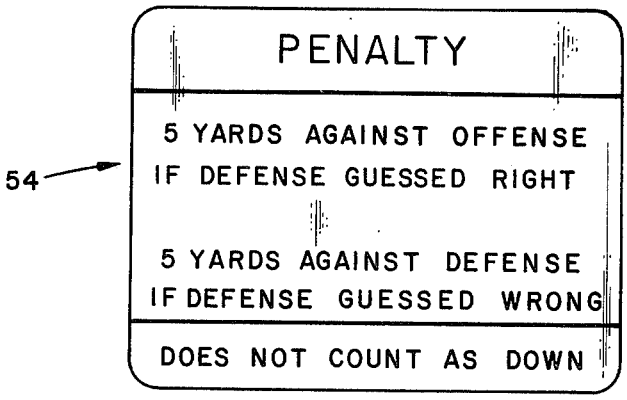
FIG. 8 is a face view of an indicia-bearing penalty card of the invention.

As in actual football there are occasions when penalties are imposed. In the subject game penalties occur by chance during the time down cards are being drawn. FIG. 8 is an example 54 of the type of penalty card randomly distributed with the down cards, FIG. 2. Penalties are assessed against the player on offense if the defense guessed the play, and against the defense if the defense made an incorrect assessment of the play in accordance with the indicia shown on said penalty cards 54. Penalty cards do not count as downs.

In one method for constructing the subject football gameboard 10 whereby football position marker 17 and first-down yardage-indicating marker 20 are retained, respectively, within longitudinal grooves 18, 21, said gameboard comprises a first base layer 48 overlain by and bonded to a second upper surface 49. Said base layer 48 and upper surface 49 may be manufactured of wood, cardboard, plastic, metal or composition substance. Base layer 48 has longitudinal grooves 18, 21, provided therein for the retention and slidable passage therethrough of an extension 50, 51 of football position marker 17 and first-down yardage-indicating marker 20, respectively. Said extensions 50, 51 are connected to football position marker 17 and first-down yardage indicating marker 20 by narrow neck portions 52, 53, respectively.

Said narrow neck portions 52, 53 of said markers 17, 20 having extensions 50, 51 thereupon are passed through a narrow longitudinal groove in upper surface 49, said narrow longitudinal groove in upper surface 49 being superimposed over longitudinal grooves 18, 21 in base layer 48 whereupon said neck portions 52, 53 are engaged with the body portion of football position marker 17 and first-down yardage-indicating marker 20, respectively, and whereby said markers 17, 20 are slidably retained by said second upper surface 49. Said upper surface 49 is thereupon bonded to base layer 48 having longitudinal grooves 18, 21 adapted therein to receive extensions 50, 51. Said markers 17, 20 are thereby fixedly a part of said gameboard 10 and are slidably mounted thereto.

One method for bonding said extensions to the body of said markers is shown in FIG. 5 wherein extension 50 is threadably engaged to the body portion of football position marker 17 by narrow threaded neck portion 52. Alternatively, first-down yardage-indicating marker 20 is shown constructed as a single entity, FIG. 7. In this embodiment, marker 20 is forcibly pressed through the narrow longitudinal groove in an expandable upper surface 49 whereby said marker 20 is retained within longitudinal groove 21.

The construction of said markers 17, 20 is not necessarily limited to the foregoing described methods since it is recognized that any smoothly slidable, suitably weighted playing pieces can accomplish the purpose as described herein.

In accordance with the foregoing description of the principal parts of the invention, the game is begun by placing the names of each player on a score pad. A coin may be flipped with one player calling "heads" or "tails". The winner of the coin flip chooses to either receive the kickoff and thus be the Offense as the team attempting to score or to kick off and thus be the Defense as the team trying to prevent a score.

The players sit across from each other facing Pass, Run sections 15, 16, at opposite ends of gameboard 10.

The player who starts the game on Offense has the responsibility during the first half of the game for turning over down cards 25 while the player who starts the game on Defense is responsible throughout the first half for turning over kick cards. This is reversed during the second half of the game.

The Offense shuffles the down cards and the Defense cuts them. The Offense then counts out 40 cards, lying the others aside. The 40 down cards constitute the first half of the game. The Defense shuffles the kick cards and the Offense cuts them.

The Defense places football position marker 17 with pointed nose 19 on his own 40 yardline and turns over two kick cards 31, reading kickoff distance from the first kick card and runback distance from the second kick card. The Defense then moves football position marker 17 to the correct point on gameboard 10, i.e., Kickoff yardage minus runback yardage.

The Offense takes control of the ball at the point where the kickoff runback ended. The Offense places first-down yardage-indicating marker 20 so that one end is at the same yardline as football position marker 17 whereupon the other end is positioned at a point 10 yards upfield toward the opponent's goal. Firstdown yardage-indicating marker 20 remains in this position until a new first down is achieved or until the football otherwise changes hands. The Offense is responsible for resetting yardage indicating marker 20 at the beginning of each new series of downs.

Although the Offense has the ultimate goal of scoring points, the short-term objective is to gain at least 10 yards within every four plays. The play, therefore, proceeds as follows:

a. The Offense, using shield 40 to hide Pass, Run sections 15, 16, decides on the play, then slides play designation marker 45 onto either Pass section 15 or Run section 16 and announces "ready".

b. The Defense then moves his play designation marker 45 to either Pass section 15 or Run section 16 at his end of the field. The Defense player, at this point, tries to anticipate the offensive play call and, by guessing correctly, minimize the yardage gained by the Offense.

c. The Offense then removes opaque shield 40 and turns over a down card 25. The outcome is determined by comparing the Offense call 26 with the Defense guess 27 as indicated in the play result column.

The Defense is responsible for moving down button indicator 24 to the appropriate indicia 23 showing which of the four downs is to be played. In order for the Offense to retain possession of the football it is necessary for the Offense to gain at least 10 yards within every four plays. If all four plays are used and ten yards are not gained, the Defense takes over possession of football position marker 17 and becomes the Offense with a first down of its own.

If, on any down, the Offense prefers to switch to Defense, the Offense has the option of a quick kick on any of the first three downs, but not on the fourth down. Results are determined by the Defense turning two kick cards 31 face up and reading distance from the distance column 33 which intersects the appropriate kick row on the first card. The runback is similarly established by reading runback from the runback column 34 which intersects the appropriate kick row on the second kick card 31.

Kick cards have been statistically weighted whereby quick kicks tend to net more yardage for the kicking player than punts. This is one of the strategic options available to add an additional element of excitement to the game. If the distance column 33 of kick card 31 states "blocked", the Defense takes over at the point where the play originates and there is no distance gained and no runback.

From time to time during the game, one player or the other may score points. Points are scored according to conventional football rules. If one player runs or passes the football past the opponent's goal, the Offense scores a touchdown which counts six points. After a touchdown the scoring player has the option of trying for one or two extra points. This is determined by the scoring player saying "one" or "two", turning over the top kick card 31 and reading extra-point indicia 39. The odds for the success of a single extra point are higher than for two extra points. After a touchdown and the extra-point attempt, the scoring player kicks off.

A field goal is a kick through the opponent's goal posts in actual football and is worth three points. A field goal is usually attempted when the Offense's chance for a touchdown seems poor. In the subject game, a field goal has no chance for success unless the offensive player is on the defensive player's side of the field. Field goals increase in statistical chance for success the closer the Offense is to the Defense's goal.

To try for a field goal, the Offense says "field goal" on any down inside the opponent's half of the field, turns over the top kick card 31 and reads the appropriate indicia 38 for field goals. If a field goal fails, the Defense becomes the Offense and starts from its own 20 yardline. If a field goal is good, the scoring player kicks off.

If the Offense loses yards on a play and is tackled within its own end zone (behind the Offense's goal), the Defense scores a safety which is worth 2 points. After a safety, the player scored on must punt from his own 20-yardline.

When all 40 down cards have been used the first half of the game is over. For the second half, the player who kicked off in the first half becomes the receiver. The responsibility for turning down cards for the entire second half is thus given to the player who, in the first half, turned the kick cards and vice versa. All of the down cards are reshuffled and forty counted out to constitute the second half.

Each time points are scored, the scoring player adds points to his total on a scorepad. At the end of the game the player with the most points wins the game. If point totals for each player are equal the game is a tie.

The subject invention provides a game wherein each player can participate throughout and who can thereby directly utilize personal strategy to try to outwit his opponent. As is seen in the foregoing description, multiple play results are possible depending upon the chance choice of a specific down or kick card and wherein said results are also affected by personal strategy in trying to outguess and outwit one's opponent in his choice of plays.

A preferred embodiment of this invention has been set forth in the description and drawings. These descriptions are used in the generic sense only and not for purposes of limitation. Various changes may, therefore, be made therein without departing from the spirit and scope of the invention.

What is claimed is:

1. A simulated football game comprising:

a. a simulated football playing field including yard line and play selection indicia,
b. means for an offensive and a defensive player to indicate his choice of a play,
c. means for achieving secrecy in play selection by said offensive player,
d. means for representing the position of a ball on the simulated playing field,
e. means for indicating the yard line on the simulated playing field which must be achieved in order to accomplish a first down,
f. down indicating means,
g. a multiplicity of offensive play designation down cards having a plurality of play situations disposed thereon, and
h. a multiplicity of kick cards having a plurality of kicking situations disposed thereon.

2. A simulated football game as set forth in claim 1, wherein said means for an offensive and a defensive player to indicate his choice of a play consists of play selection markers superimposed upon said play selection indicia.

3. A simulated football game as set forth in claim 1, wherein the means for representing the position of a ball on the simulated playing field comprises the forward pointed portion of a movable marker having an ovate shape.

4. A simulated football game as set forth in claim 3, wherein said movable marker for representing the position of a ball on the simulated playing field is slidably mounted within a longitudinal groove on one side of said simulated football playing field.

5. A simulated football game as set forth in claim 1, wherein the means for indicating the yard line on said simulated playing field which must be achieved in order to accomplish a first down comprises a movable marker having a length corresponding to a simulated ten-yard interval.

6. A simulated football game as set forth in claim 5, wherein said movable marker for indicating the yard line on said simulated playing field which must be achieved in order to accomplish a first down is slidably mounted within a longitudinal groove on one side of said simulated football playing field.

7. A simulated football game as set forth in claim 1, wherein said down indicating means consists of a slidable down marker progressively movable to indicate each play in a series of downs.

8. A simulated football game as set forth in claim 1, wherein said means for achieving secrecy in play selection comprises an opaque shield behind which the offensive player may conceal his choice of a pass or run option from the defensive player.

9. a simulated football game as set forth in claim 1, wherein said offensive play designation down cards comprise a plurality of play situations wherein each of said down cards has a plurality of mutually perpendicular columns and rows, indicia representing offensive calls, defensive guesses and play results, said indicia being arranged columnarly and whereby rows of indicia representing said offensive calls intersect said defensive guesses in the horizontal plane to provide play results for each play.

10. A simulated football game as set forth in claim 1, wherein said multiplicity of kick cards comprise a plurality of kicking situations wherein each of said kick cards has a plurality of mutually perpendicular columns and rows, indicia representing the strategic and tactical kicks used to move the ball in the game of football, distances for said kicks, runbacks for said kicks, said indicia arranged columnarly and whereby rows of indicia representing said types of strategic and tactical kicks intersect said distance columns and said runback columns in the horizontal plane and including indicia to provide results for attempted field goals and indicia to provide results for scoring extra points.

11. A method for playing a simulated game of football wherein a player in the offensive position secretly chooses and indicates a play option for advancing a football toward an opponent's goal upon a simulated football playing field having play selection indicia disposed thereon, whereupon a second player in the defensive position attempts to predict and thereupon indicate said play option chosen by said player in the offensive position whereby said second player can achieve tactical and strategic advantage in the ultimate outcome of said simulated game of football and whereby the results of the offensive player's choice and the defensive player's prediction are determined by reference to one of a multiplicity of offensive play designation down cards having a plurality of play situations disposed thereon.

12. A method for playing a simulated game of football as set forth in claim 11 wherein said play options comprise a choice of passing or running said football toward said opponent's goal.

13. A method for playing a simulated game of football as set forth in claim 12 wherein said method by which said player in the offensive position secretly chooses a play option comprises the utilization of an opaque shield behind which said player in the offensive position may conceal his choice of said play option from said second player in the defensive position.

14. A method for playing a simulated game of football as set forth in claim 11 wherein said player in the offensive position may choose to kick the football to attain a tactical and strategic advantage in the ultimate outcome of said simulated game of football.

15. A method for playing a simulated game of football as set forth in claim 14 wherein the results of said offensive player's choice to kick the football is determined by reference to at least one of a multiplicity of kick cards having a plurality of kicking situations disposed thereon.

16. A method for playing a simulated game of football as set forth in claim 11 wherein the method by which said offensive player and said defensive player indicate said play options comprises the utilization of play selection markers superimposed upon said play selection indicia disposed on said simulated football playing field.

* * * * *